US009849397B2

(12) United States Patent
Saegusa et al.

(10) Patent No.: US 9,849,397 B2
(45) Date of Patent: Dec. 26, 2017

(54) COMMUNICATION DEVICE AND STEERED DEVICE

(71) Applicant: Futaba Corporation, Mobara-shi, Chiba (JP)

(72) Inventors: Masahiro Saegusa, Mobara (JP); Hiroyuki Tsuchiya, Mobara (JP); Masahiro Tanaka, Mobara (JP); Kota Toyotomi, Mobara (JP)

(73) Assignee: FUTABA CORORATION, Mobara-Shi, Chiba (JP)

( * ) Notice: Subject to any disclaimer, the term of this patent is extended or adjusted under 35 U.S.C. 154(b) by 0 days.

(21) Appl. No.: 14/840,988

(22) Filed: Aug. 31, 2015

(65) Prior Publication Data

US 2016/0062355 A1 Mar. 3, 2016

(30) Foreign Application Priority Data

Sep. 3, 2014 (JP) ..... 2014-179157

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***A63H 30/04*** | (2006.01) |

(52) U.S. Cl.

CPC ..... *A63H 30/04* (2013.01)

(58) Field of Classification Search

CPC ..... A63H 30/04
USPC ..... 701/2
See application file for complete search history.

(56) References Cited

U.S. PATENT DOCUMENTS

| | | | | |
|---|---|---|---|---|
| 2004/0098140 | A1* | 5/2004 | Hess | G05D 1/0077 700/3 |
| 2006/0214501 | A1* | 9/2006 | Riddiford | B60T 8/885 303/20 |
| 2009/0048689 | A1* | 2/2009 | Pelton | B64D 45/0005 700/33 |
| 2011/0106339 | A1* | 5/2011 | Phillips | G05D 1/0033 701/2 |

(Continued)

FOREIGN PATENT DOCUMENTS

| | | |
|---|---|---|
| JP | 10-230083 | 9/1998 |
| JP | 2013-67279 | 4/2013 |

OTHER PUBLICATIONS

German Patent and Trade Mark Office, Official Action, Serial No. 10 2015 114 494.8, dated Oct. 27, 2016.

*Primary Examiner* — Harry Oh
(74) *Attorney, Agent, or Firm* — Quarles & Brady LLP

(57) ABSTRACT

A communication device includes a first terminal unit connected to an actuator device having a sensor. Transmission of a steering signal transmitted from a steering wireless device to the actuator device, and transmission of detected signal detected by the sensor in the actuator device are conducted via the first terminal unit. The communication device further includes a control unit. The control unit conducts processing to generate a connection error signal representing that the actuator device are not connected on the basis of a result of determination whether the detected signal is acquired from the actuator device via the first terminal unit, and transmit the connection error signal to the steering wireless device side.

4 Claims, 6 Drawing Sheets

(56) References Cited

U.S. PATENT DOCUMENTS

| | | | | |
|---|---|---|---|---|
| 2011/0251739 | A1* | 10/2011 | Tomas | B64C 13/503 701/3 |
| 2014/0214187 | A1 | 7/2014 | Redenbo et al. | |
| 2016/0001878 | A1* | 1/2016 | Lee | B64C 3/38 244/7 A |

* cited by examiner

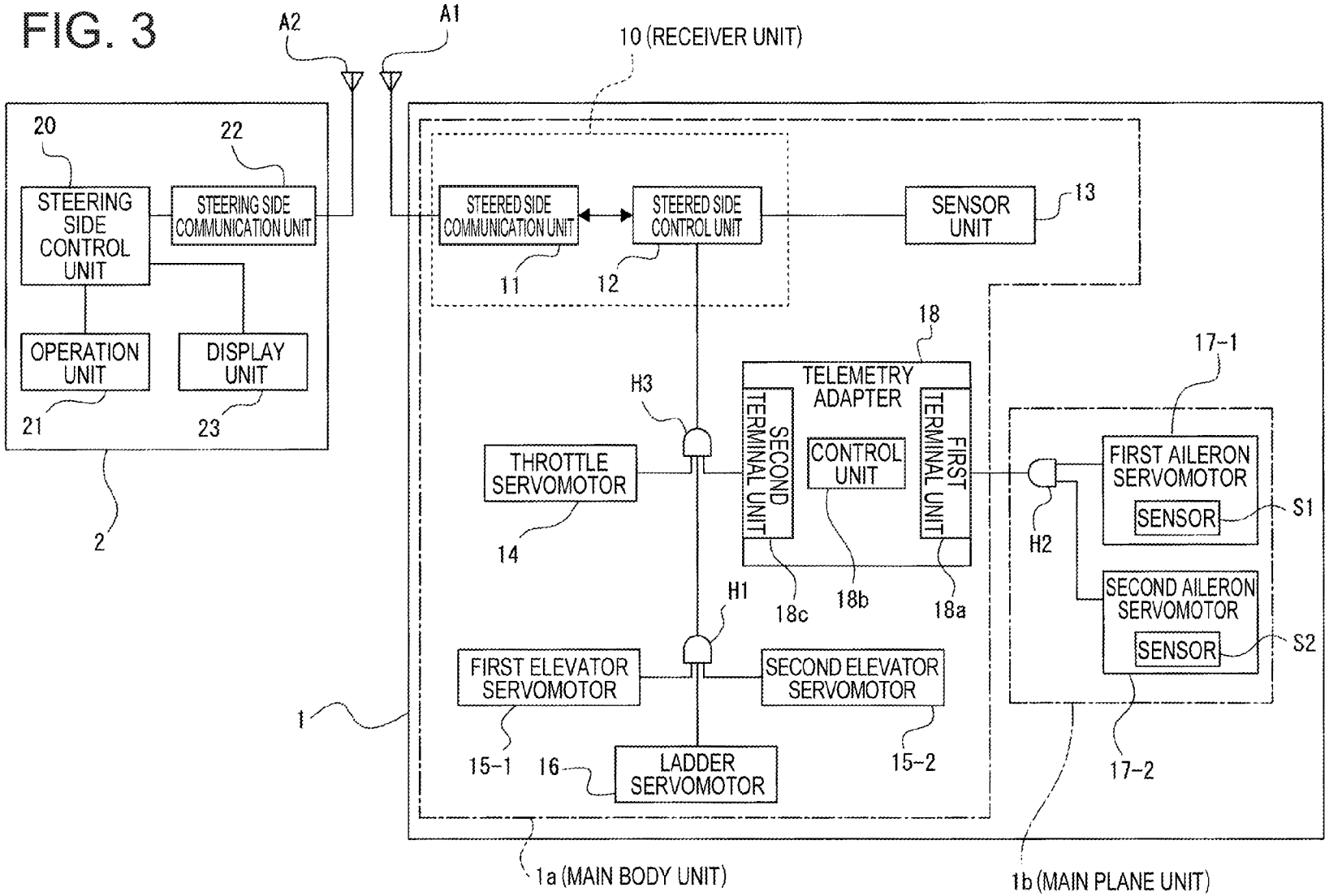
FIG. 3
10 (RECEIVER UNIT)
A1
A2
STEERED SIDE COMMUNICATION UNIT
11
STEERED SIDE CONTROL UNIT
12
SENSOR UNIT
13
STEERING SIDE COMMUNICATION UNIT
22
STEERING SIDE CONTROL UNIT
20
OPERATION UNIT
21
DISPLAY UNIT
23
2
H3
THROTTLE SERVOMOTOR
14
TELEMETRY ADAPTER
18
FIRST TERMINAL UNIT
18a
CONTROL UNIT
18b
SECOND TERMINAL UNIT
18c
H1
FIRST ELEVATOR SERVOMOTOR
15-1
SECOND ELEVATOR SERVOMOTOR
15-2
LADDER SERVOMOTOR
16
1a (MAIN BODY UNIT)
1
H2
FIRST AILERON SERVOMOTOR
17-1
SENSOR
S1
SECOND AILERON SERVOMOTOR
17-2
SENSOR
S2
1b (MAIN PLANE UNIT)

COMMUNICATION DEVICE AND STEERED DEVICE

CROSS-REFERENCE TO RELATED APPLICATIONS

This application claims priority under 35 U.S.C. §119 to Japanese Patent Application 2014-179157 filed Sep. 3, 2014, the disclosure of which is incorporated herein by reference in its entirety.

BACKGROUND

Technical Field

The present invention relates to a technical field concerning a communication device provided in a steered device such as the so-called radio control model, which is remote steered on the basis of a steering signal from a steering wireless device, and the steered device.

Related Art

Steered devices functioning as various radio control devices imitating, for example, an airplane, a helicopter, an automobile, a ship, a robot, and so forth are known. When making these steered devices fly or travel, a steering person operates an operation stick provided in a steering wireless device. The steering wireless device generates a steering signal corresponding to an operation amount of the operation stick, and transmits the steering signal to the steered device. In the steered device, a receiver unit receives the transmitted steering signal and the receiver unit supplies the steering signal to actuator devices such as, for example, servo motors, which controls respective units in the steered device. As a result, the steering person can execute remote steering of the steered device by operating the operation stick.

As for related prior techniques, JP 10-230083 A and JP 2013-67279 A can be mentioned.

SUMMARY

In steered devices imitating, for example, an air plane, there is a steered device in which a main plane unit can be attached to/detached from a body unit (main body unit), considering easiness of conveyance and so forth. A servomotor for driving a flap for an aileron (aileron servomotor) is mounted on the main plane unit. Furthermore, a receiver unit is mounted on the body unit to supply the steering signal received from the steering wireless device to respective servomotors. Usually, therefore, a connector for connecting the receiver unit to the aileron servomotor is also detached when detaching the main plane unit from the body unit at the time of conveyance or the like.

In the steered device in which the main plane unit can be detached as described above, however, there is a possibility described below. That is, the steering person might forget to connect wiring lines between the actuator devices side functioning as the aileron servomotor and the receiver unit side, when attaching the main plane unit to the body unit at the time of flight. If the flight is started in this state as it is, a danger such as a crash is brought about in the worst case.

In preventing forgetting to connect the actuator devices, it is conceivable to provide a terminal for confirming conduction on each of the receiver unit side and the actuator devices side and give an error notice to the steering wireless device side in a case where conduction via the conduction confirmation terminals is not confirmed on the receiver unit side.

In this technique, however, it is necessary to add a terminal on each of the receiver unit side and the actuator devices side newly. Furthermore, a user such as a steering person cannot use existing actuator devices having no conduction confirmation terminal as it is, when enjoying the connection error notifying function described above. The user is forced to have a burden of purchasing actuator devices newly.

Therefore, it is an object of the present invention to overcome the above-described problem and implement a wireless steering system capable of notifying forgetting of connection of actuator devices without additionally providing a terminal for conduction confirmation.

First, a communication device according to the present invention includes a first terminal unit connected to actuator devices having sensors. Transmission of a steering signal transmitted from a steering wireless device to the actuator devices, and transmission of detected signal detected by the sensors in the actuator devices are conducted via the first terminal unit. The communication device according to the present invention further includes a control unit. The control unit is configured to conduct processing to generate a connection error signal representing that the actuator devices are not connected on the basis of a result of determination whether the detected signal is acquired from the actuator devices via the first terminal unit, and transmit the connection error signal to the steering wireless device side.

As a result, confirmation of connection of the actuator devices is conducted on the basis of whether the sensor-detected signal is acquired via the terminal unit for transmitting the steering signal or the sensor-detected signal with the actuator devices.

Secondly, it is desirable that the communication device according to the present invention includes a second terminal unit connected to a receiver unit side including a communication unit configured to conduct wireless communication with the steering wireless device.

The communication device is inserted between the receiver unit and the actuator devices and used as represented by the telemetry adapter 18 described later (see, for example, FIG. 3).

Thirdly, it is desirable that the communication device according to the present invention includes a communication unit configured to conduct wireless communication with the steering wireless device.

The communication device is equivalent to the receiver unit including the communication unit, which conducts wireless communication with the steering wireless device.

Furthermore, first, a steered device according to the present invention includes actuator devices having sensors. The steered device according to the present invention further includes a communication device. The communication device includes a first terminal unit connected to actuator devices having sensors. Transmission of a steering signal transmitted from a steering wireless device to the actuator devices, and transmission of detected signal detected by the sensors in the actuator devices are conducted via the first terminal unit. The communication device further includes a control unit. The control unit is configured to conduct processing to generate a connection error signal representing that the actuator devices are not connected on the basis of a result of determination whether the detected signal is acquired from the actuator devices via the first terminal unit, and transmit the connection error signal to the steering wireless device side.

In such a steered device as well, confirmation of connection of the actuator devices is conducted on the basis of whether the sensor-detected signal is acquired via the terminal unit for transmitting the steering signal or the sensor-detected signal with the actuator devices, in the same way as the communication device.

Secondly, in the steered device according to the present invention, it is desirable that a portion is configured to be capable of attached to and detached from a main body unit, and the actuator devices are disposed in the portion, whereas the communication device is disposed in the main body unit.

As a result, it is made possible to give a notice that connection of the actuator devices disposed in the portion of the steered device to the main body unit side is forgotten.

According to the present invention, it is possible to implement a wireless steering system capable of giving a notice that connection of the actuator devices is forgotten without providing terminals for conduction confirmation additionally.

BRIEF DESCRIPTION OF DRAWINGS

FIG. 3 is a block diagram illustrating a circuit configuration of the steered device and a steering wireless device in the embodiment;

DETAILED DESCRIPTION

Hereafter, embodiments of the present invention will be described.

Figure 1:
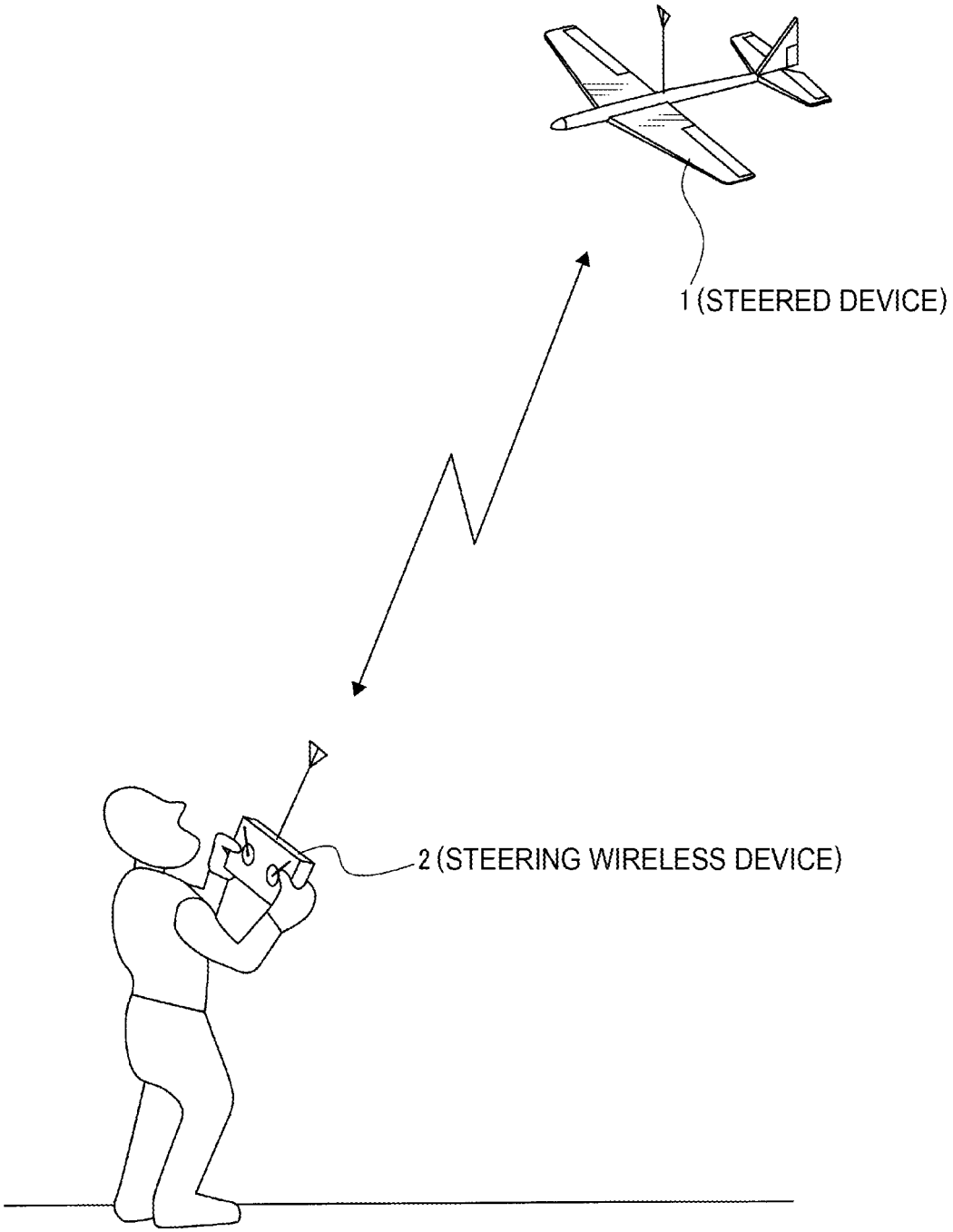
FIG. 1 is a diagram illustrating a configuration example of a wireless steering system of a radio control model in an embodiment of the present invention.

FIG. 1 illustrates a configuration example of a wireless steering system of a radio control model including a steered device 1 and a steering wireless device 2 in an embodiment.

In FIG. 1, the steered device 1 is configured as a radio control model that imitates an airplane. An operation stick is provided in the steering wireless device 2 for a steering person to exercise remote steering on the steered device 1. The steering wireless device 2 transmits a steering signal depending upon an operation amount of the operation stick to the steered device 1. Furthermore, the steering wireless device 2 in the present embodiment is made capable of receiving a signal (for example, a signal indicating a state of the steered device 1) transmitted from a receiver unit 10 (described later with reference to FIG. 3), which is mounted on the steered device 1.

As described later, a display unit 23 is provided on the steering wireless device 2. The steering wireless device 2 is made capable of exhibiting visually information depending upon a signal received from the steered device 1 to the steering person via the display unit 23.

In a case of the present example, two operation sticks are provided on the steering wireless device 2. The steering person can operate these operation sticks vertically and laterally, respectively. The steering wireless device 2 is made capable of outputting steering signals of four channels in total corresponding to vertical operation and lateral operation of a first operation stick and vertical operation and lateral operation of a second operation stick.

Figure 2:
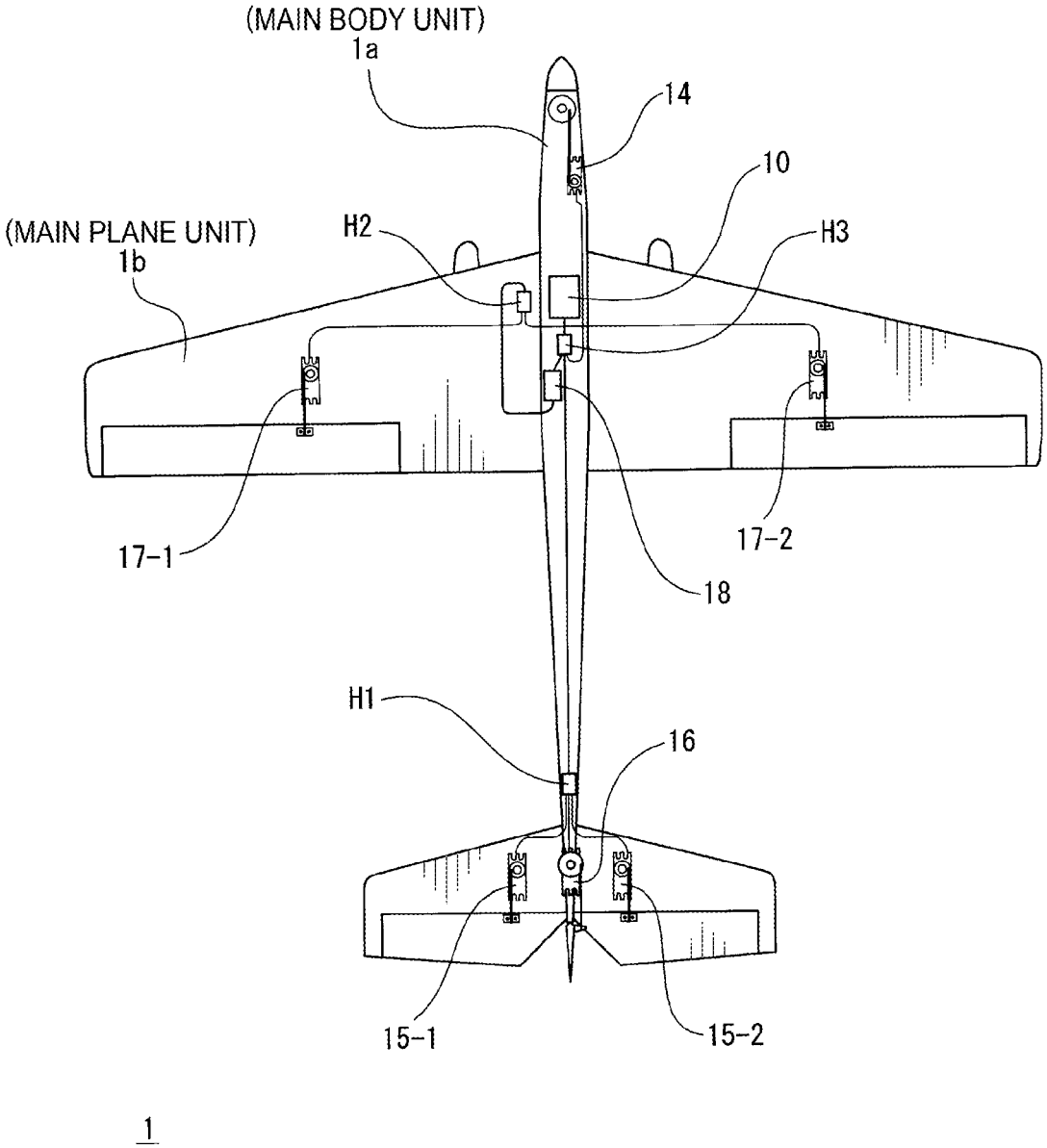
FIG. 2 is a perspective top view illustrating a configuration of a steered device in the embodiment.

FIG. 2 is a perspective top view illustrating a configuration of the steered device 1 schematically.

The steered device 1 includes a main body unit 1*a* and a main plane unit 1*b*. The main body unit 1*a* includes a body unit mounting the receiver unit 10 and an engine, and a tail unit. The main plane unit 1*b* is made capable of being attached to and detached from the body unit in the main body unit 1*a*. Furthermore, the steered device 1 includes flaps for an elevator and a ladder in the tail unit and includes flaps for aileron in the main plane unit 1*b*. In addition, the steered device 1 includes a throttle servomotor 14, a first elevator servomotor 15-1, a second elevator servomotor 15-2, a ladder servomotor 16, a first aileron servomotor 17-1, and a second aileron servomotor 17-2 as actuator devices for driving the flaps and engine throttles.

The throttle servomotor 14 is disposed in the body unit in the main body unit 1*a* to drive an engine throttle disposed in the body unit. The first elevator servomotor 15-1 and the second elevator servomotor 15-2 are disposed in a horizontal tail unit in the main body unit 1*a* to drive respectively corresponding ones in one pair of left and right flaps for elevator provided in the horizontal tail unit. The ladder servomotor 16 is disposed in a vertical tail unit in the main body unit 1*a* to drive a flap for ladder provided in the vertical tail unit. The first aileron servomotor 17-1 and the second aileron servomotor 17-2 are disposed in the main plane unit 1*b* to drive respectively corresponding ones in one pair of left and right flaps for aileron provided in the main plane unit 1*b*.

In the present embodiment, the first aileron servomotor 17-1 and the second aileron servomotor 17-2 are made as actuator devices each having a sensor. As the sensors (sensors S1 and S2 described later) included in the first aileron servomotor 17-1 and the second aileron servomotor 17-2, for example, a temperature sensor using a thermistor, an operation position sensor, which detects a motor operation position, and so forth can be mentioned.

In the steered device 1 in the present embodiment, a telemetry adapter 18 is provided as a configuration for acquiring sensor-detected signals obtained by the first aileron servomotor 17-1 and the second aileron servomotor 17-2 functioning as such actuator devices having sensors and transferring the sensor-detected signals to the receiver unit 10. The telemetry adapter 18 is disposed in the body unit in the main body unit 1*a*.

In the present example, the receiver unit 10, the telemetry adapter 18, and various servomotors included in the steered device 1 are made as devices corresponding to bus communication. In implementing bus communication, setting as to correspondence between the throttle, ladder, elevator, and aileron servomotors and channels of the steering signals is conducted previously. Such setting of channels to respective servomotors is implemented by, for example, operation of assigning channels to individual servomotors conducted by the steering person via the steering wireless device 2.

By setting channels to respective servomotors, it is not necessary to divide wiring lines between the receiver unit 10 and the servomotors every channel, and servomotors can receive steering signals on respective corresponding channels.

As illustrated in FIG. 2, three three-forked hubs H are provided in the steered device 1 to collect wiring lines from servomotors corresponding to bus communication (three-forked hub H1, three-forked hub H2, and three-forked hub H3). Bus wiring lines from the first elevator servomotor 15-1, the second elevator servomotor 15-2, and the ladder servomotor 16 are connected to the three-forked hub H1. Bus wiring lines from the first aileron servomotor 17-1 and the second aileron servomotor 17-2 are connected to the three-forked hub H2. A bus wiring line from the three-forked hub H2 is connected to the telemetry adapter 18 as illustrated in FIG. 2.

A bus wiring line from the throttle servomotor 14, a bus wiring line from the three-forked hub H1, and a bus wiring line from the telemetry adapter 18 are connected to the three-forked hub H3. A bus wiring line from the three-forked hub H3 is connected to the receiver unit 10.

Besides the sensors included in the first aileron servomotor 17-1 and the second aileron servomotor 17-2, a sensor unit 13 is also provided in the steered device 1 to detect states of respective units in the steered device 1. However, the sensor unit 13 is not illustrated in FIG. 2.

Furthermore, batteries for supplying operation power supplies to the receiver unit 10, the telemetry adapter 18, and the respective servomotors are also included in the steered device 1. However, the batteries are not illustrated.

As for the connection form of the respective units using the three-forked hubs H, the form illustrated in FIG. 2 is nothing but an example. It is a matter of course that other forms can be taken.

FIG. 3 is a block diagram illustrating a circuit configuration of the steered device 1 and the steering wireless device 2.

The steering wireless device 2 includes a steering side control unit 20, an operation unit 21, a steering side communication unit 22, a display unit 23, and an antenna A2. The operation unit 21 and the steering side communication unit 22 are connected to the steering side control unit 20. The antenna A2 is connected to the steering side communication unit 22.

Various operation elements such as the above-described operation sticks and operation are provided in the operation unit 21. The steering side control unit 20 acquires a signal corresponding to an operation input conducted by a steering person by using these operation elements.

The steering side communication unit 22 is configured to be capable of conducting transmission and reception of signals by a predetermined wireless communication method with an external device (especially the steered device 1) via the antenna A2.

The display unit 23 is configured to include a display such as, for example, an LCD (Liquid Crystal Display) or an organic EL (Electro-Luminescence). The display unit 23 displays various kinds of information on the basis of control from the steering side control unit 20. The display included in the display unit 23 is provided to exhibit a display screen unit to the outside.

The steering side control unit 20 is formed of, for example, an information processing device such as a microcomputer including a CPU (Central Processing Unit) and a memory such as a ROM (Read Only Memory) and a RAM (Random Access Memory). The steering side control unit 20 exercises general control of the steering wireless device 2 by conducting processing according to a program stored in the memory such as the ROM.

For example, the steering side control unit 20 causes the steering side communication unit 22 to transmit a steering signal depending upon an operation amount of an operation stick provided in the operation unit 21 together with information representing a channel of the steering signal to an external device via the antenna A2.

Furthermore, the steering side control unit 20 exercises control to cause the display unit 23 to display corresponding information on the basis of a signal (for example, the above-described signal indicating the state of the steered device 1) received from an external device functioning as the steered device 1 by the steering side communication unit 22.

The steered device 1 includes the sensor unit 13 besides the respective units illustrated in FIG. 2.

The sensor unit 13 is a sensor for detecting the state of the steered device 1. Sensors that can be provided as the sensor unit 13 are, for example, an altitude sensor (atmospheric pressure sensor) for detecting a flight altitude of the steered device 1, and a GPS (Global Positioning System) sensor for detecting the current position. An optical rotation sensor for detecting the number of rotations of a propeller or the like driven by an engine, a voltage sensor (a type inserted into an arbitrary wiring line and used), and so forth can also be provided as the sensor unit 13.

The sensor unit 13 is connected to the steered side control unit 12 in the receiver unit 10.

The receiver unit 10 includes a steered side communication unit 11 and the steered side control unit 12. An antenna A1 is connected to the steered side communication unit 11.

The steered side communication unit 11 is configured to be capable of transmit/receive signals to/from the steering wireless device 2 via the antenna A1 according to a predetermined wireless communication method.

The steered side control unit 12 is formed of, for example, an information processing device such as a microcomputer including a CPU and a memory such as a ROM and a RAM. The steered side control unit 12 implements various operations conducted as the receiver unit 10 by conducting processing according to a program stored in the memory such as the ROM.

Although not illustrated, a terminal unit is provided in the receiver unit 10 to conduct bus communication with various servomotors. A bus wiring line from the three-forked hub H3 is connected to the terminal unit. As a result, the steered side control unit 12 is made capable of conduct bus communication with each servomotor and the telemetry adapter 18. The servomotor is included in the throttle servomotor 14, the first elevator servomotor 15-1, the second elevator servomotor 15-2, the ladder servomotor 16, the first aileron servomotor 17-1, and the second aileron servomotor 17-2 connected together with the telemetry adapter 18 by bus wiring lines via the three-forked hub H3, the three-forked hub H2, and the three-forked hub H1.

Furthermore, the steered side control unit 12 causes the steered side communication unit 11 to transmit a detected signal from the sensor unit 13 to the steering wireless device 2 (the steering side control unit 20).

In the steering wireless device 2, the steering side control unit 20 causes the display unit 23 to display information corresponding to the detected signal as occasion demands (for example, in response to an operation input of the steering person) on the basis of the transmitted detected signal.

A sensor S1 is provided in the first aileron servomotor 17-1. A sensor S2 is provided in the second aileron servomotor 17-2. As appreciated from the foregoing description, the sensor S1 and the sensor S2 are, for example, temperature sensors, operation position sensors, or the like.

The telemetry adapter 18 includes a first terminal unit 18*a*, a control unit 18*b*, and a second terminal unit 18*c*. The first terminal unit 18*a* is connected to the servomotor side. The control unit 18*b* is formed of, for example, an information processing device such as a microcomputer including a CPU and a memory such as a ROM and a RAM. The second terminal unit 18*c* is connected to the receiver unit 10 side.

In the case of the present example corresponding to the bus communication, the first terminal unit 18*a* and the second terminal unit 18*c* are configured to be capable of connecting to bus wiring lines. A bus wiring line from the three-forked hub H2 is connected to the first terminal unit 18*a*. A bus wiring line connected to the second terminal unit 18*c* is connected to the three-forked hub H3. As a result, the control unit 18*b* in the telemetry adapter 18 is made capable of communicate with the first aileron servomotor 17-1 and the second aileron servomotor 17-2 via the first terminal unit 18*a* and the three-forked hub H2. The control unit 18*b* in the telemetry adapter 18 is also made capable of communicate with the steered side control unit 12 in the receiver unit 10 via the second terminal unit 18*c* and the three-forked hub H3.

In the telemetry adapter 18, a steering signal transmitted from the steering wireless device 2 is received by the control unit 18*b* via the receiver unit 10 and the second terminal unit 18*c*. The control unit 18*b* outputs the received steering signal to the first aileron servomotor 17-1 and the second aileron servomotor 17-2 side via the first terminal unit 18*a*. When requesting detected signals of the sensors S1 and S2, the steering wireless device 2 issues a sensor-detected signal request, which will be described later. The sensor-detected signal request is also received by the control unit 18*b* via the receiver unit 10 and the second terminal unit 18*c*. The control unit 18*b* outputs the received sensor-detected signal request to the first aileron servomotor 17-1 and the second aileron servomotor 17-2 side via the first terminal unit 18*a*. In addition, in a case where the first aileron servomotor 17-1 and the second aileron servomotor 17-2 output a sensor-detected signal in response to the sensor-detected signal request, the sensor-detected signal is transmitted to the control unit 18*b* via the first terminal unit 18*a*.

In this way, via the first terminal unit 18*a*, a steering signal and the sensor-detected signal request from the steering wireless device 2 are transmitted to the first aileron servomotor 17-1 and the second aileron servomotor 17-2 connected via the first terminal unit 18*a*. Via the first terminal unit 18*a*, sensor-detected signals output by the first aileron servomotor 17-1 and the second aileron servomotor 17-2 are also transmitted.

The first terminal unit 18*a* is formed in the same casing as that of the control unit 18*b*. The first terminal unit 18*a* is an input/output unit of the telemetry adapter 18, which outputs the received sensor-detected signal directly to the control unit 18*b*.

The first terminal unit 18*a* is configured to facilitate attaching/detaching of the wiring line (in the present example, the bus wiring line). Connection and detaching between the telemetry adapter 18 and the three-forked hub H2 (or servomotor) can be conducted easily. As a result, the main plane unit 1*b* can be attached to/detached from the main body unit 1*a* easily.

Figure 4:
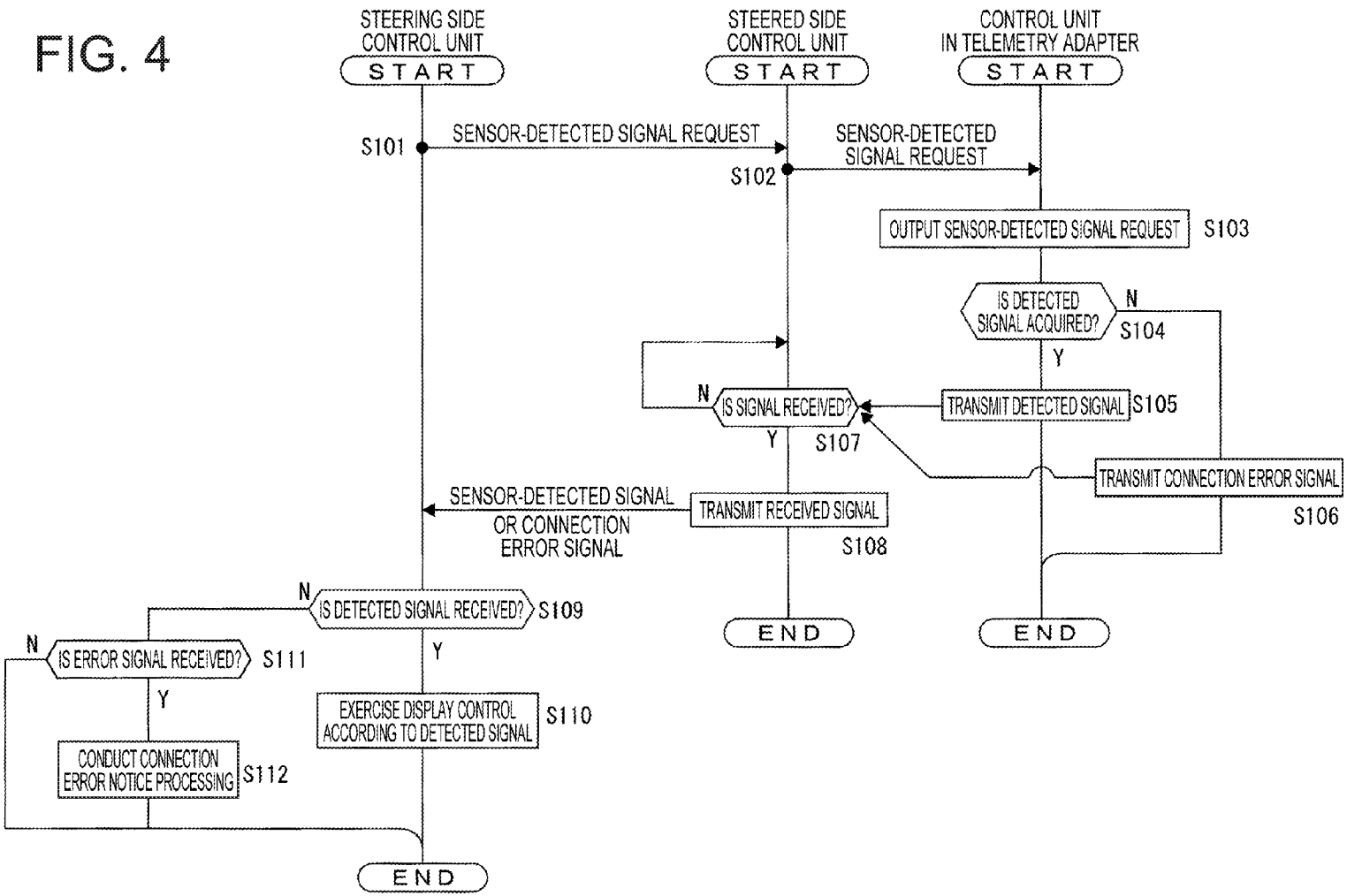
FIG. 4 is a flow chart illustrating processing concerning a function of giving a notice that connection of actuator devices is forgotten, included in processing executed in a wireless steering system in the embodiment.

FIG. 4 is a flow chart illustrating processing concerning a function of giving a notice that connection of the first aileron servomotor 17-1 and the second aileron servomotor 17-2 provided in the main plane unit 1*b* is forgotten, included in processing executed in the wireless steering system in the embodiment.

In FIG. 4, first, the steering side control unit 20 in the steering wireless device 2 issues a sensor-detected signal request to the steered side control unit 12 to request detected signals of the sensor S1 and the sensor S2 in step S101. The steering side control unit 20 issues the sensor-detected signal request repeatedly, for example, at predetermined time intervals. Or the steering side control unit 20 issues the sensor-detected signal request in response to, for example, an operation input (for example, an operation input commanding display of detected signals of the sensors S1 and S2) conducted by the steering person.

If the sensor-detected signal request issued in step S101 is received by the steered side communication unit 11, the steered side control unit 12 in the steered device 1 transfers the sensor-detected signal request to the control unit 18*b* in the telemetry adapter 18 in step S102.

Upon receiving the sensor-detected signal request transferred in step S102 via the second terminal unit 18*c*, the control unit 18*b* outputs the sensor-detected signal request via the first terminal unit 18*a* in step S103. As a result, the sensor-detected signal request is issued to the first aileron servomotor 17-1 and the second aileron servomotor 17-2.

In subsequent step S104, the control unit 18*b* determines whether sensor-detected signals from the first aileron servomotor 17-1 and the second aileron servomotor 17-2 are acquired in response to the sensor-detected signal request output in step S103. For example, the determination processing in step S104 is conducted by determining whether a sensor-detected signal is acquired within a predetermined time since the sensor-detected signal request is output in step S103.

In a case where it is determined in step S104 that sensor-detected signals from the first aileron servomotor 17-1 and the second aileron servomotor 17-2 are acquired, the control unit 18*b* proceeds to step S105, transmits the sensor-detected signals to the steered side control unit 12, and finishes the processing illustrated in FIG. 4.

On the other hand, in a case where it is determined that sensor-detected signals from the first aileron servomotor 17-1 and the second aileron servomotor 17-2 are not acquired, the control unit 18*b* proceeds to step S106. In step S106, the control unit 18*b* generates a connection error signal, which represents that the first aileron servomotor 17-1 and the second aileron servomotor 17-2 are not connected to the main body unit 1*a*, transmits the connection error signal to the steered side control unit 12, and finishes the processing illustrated in FIG. 4.

In response to the transfer of the sensor-detected signal request to the telemetry adapter 18 in preceding step S102, the steered side control unit 12 waits for reception of a signal from the telemetry adapter 18 side (that is, reception of either the sensor-detected signal or the connection error signal) in step S107. In a case where a signal is received from the telemetry adapter 18 side, the steered side control unit 12 transmits the signal received in step S108 to the steering side control unit 20, and finishes the processing illustrated in FIG. 4.

In response to issuance of the sensor-detected signal request in preceding step S101, the steering side control unit 20 determines whether the sensor-detected signal is received from the steered side control unit 12 in step S109. In a case where the sensor-detected signal is received, the steering side control unit 20 proceeds to step S110, conducts the display control processing in the display unit 23 according to the sensor-detected signal, and finishes the processing illustrated in FIG. 4.

On the other hand, in a case where the sensor-detected signal is not received, the steering side control unit 20 proceeds to step S111, and determines whether the connection error signal is received from the steered side control unit 12. In a case where the connection error signal is not received, the steering side control unit 20 finishes the processing illustrated in FIG. 4.

In a case where the connection error signal is received, the steering side control unit 20 proceeds to step S112, conducts connection error notice processing, and finishes the processing illustrated in FIG. 4. As the connection error notice processing in step S112, the steering side control unit 20 conducts, for example, processing of causing the display unit 23 to display predetermined information representing that the first aileron servomotor 17-1 and the second aileron servomotor 17-2 are not connected.

In a case where the connection error signal is not received in step S111, the steering side control unit 20 may return to step S101 after waiting for a predetermined time, and issue the sensor-detected signal request again.

The case where the telemetry adapter 18 performs the function of generating and transmitting the connection error signal in response to a result of determination whether the sensor-detected signal is acquired from the first aileron servomotor 17-1 and the second aileron servomotor 17-2 has been described above as an example. As represented by a steered device 1A illustrated in FIG. 5, however, the telemetry adapter 18 may be omitted and a receiver unit 10A, which performs the function, may be provided instead of the receiver unit 10.

Figure 5:
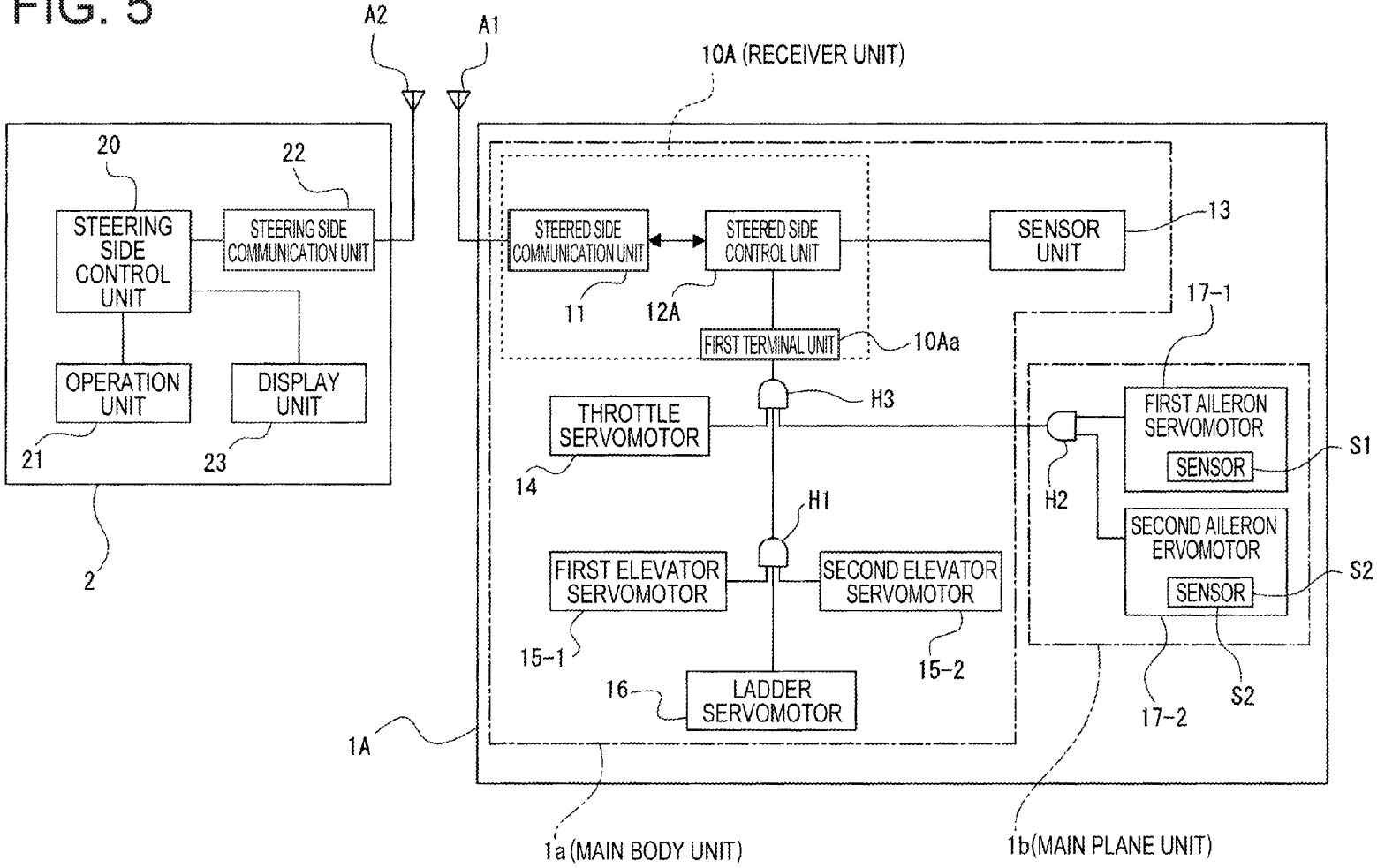
FIG. 5 is a block diagram illustrating a circuit configuration of a steered device and a steering wireless device as a modification.

In the steered device 1A in this case, a bus wiring line from the three-forked hub H2 is connected to the three-forked hub H3 as illustrated in FIG. 5. In the receiver unit 10A, a steered side control unit 12A is provided instead of the steered side control unit 12. In FIG. 5, a terminal unit for bus wiring line connection provided in the receiver unit 10A is represented as first terminal unit 10Aa. A bus wiring line from the three-forked hub H3 is connected to the first terminal unit 10Aa, and the steered side control unit 12A is made capable of communicating with the servomotor side.

Figure 6:
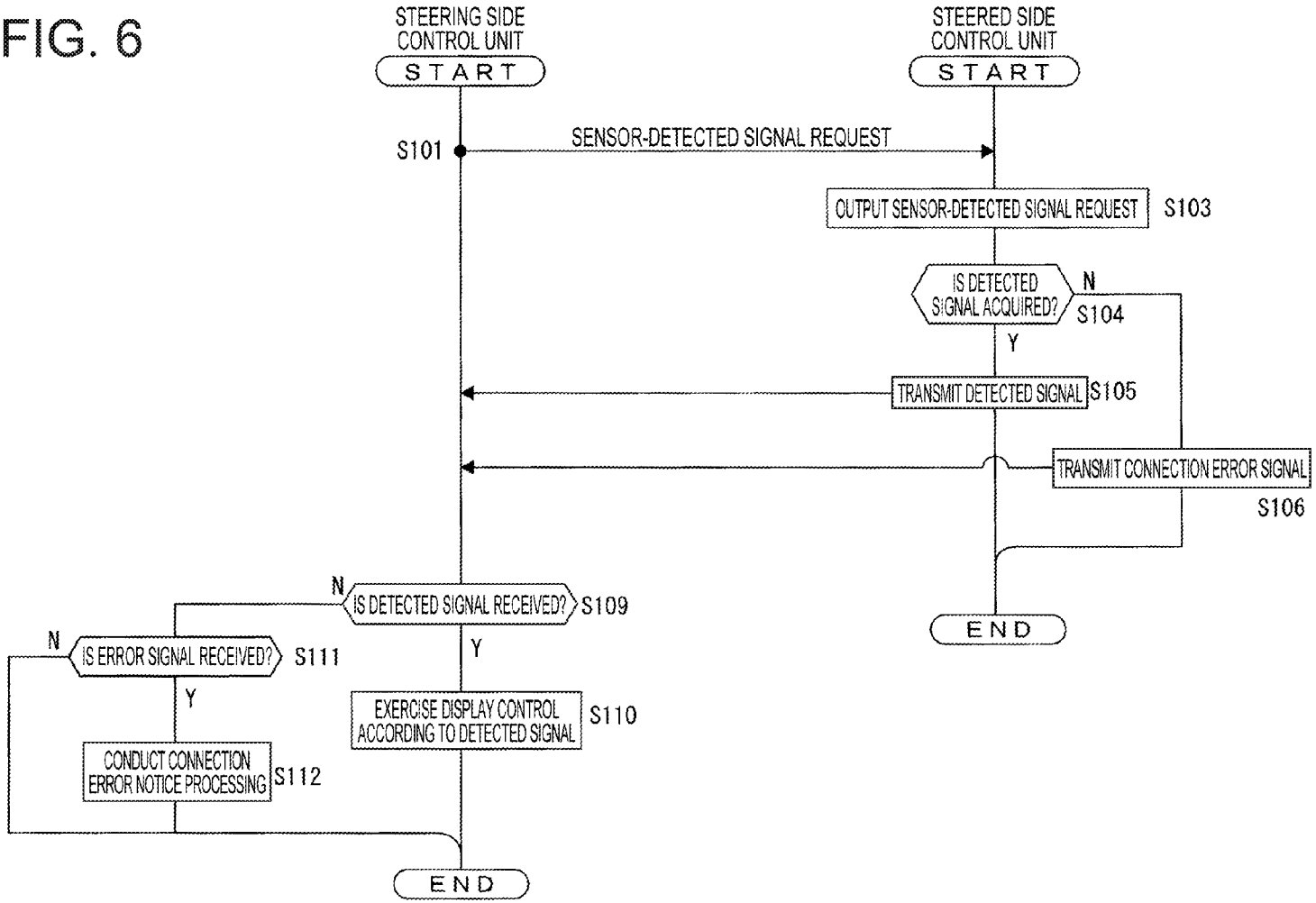
FIG. 6 is a flow chart illustrating processing concerning a function of giving a notice that connection of actuator devices is forgotten, included in processing executed in a wireless steering system as a modification.

In this case, the steered side control unit 12A conducts processing similar to the processing in the control unit 18*b* illustrated in FIG. 4. Specifically, as illustrated in a flow chart in FIG. 6, the steered side control unit 12A executes processing similar to the processing in step S103 to S106 described earlier, in response to reception of sensor-detected signal request from the steering side control unit 101.

In step S103 in this case, the steered side control unit 12A outputs the received sensor-detected signal request via the first terminal unit 10Aa. In this case, a transmission destination of the sensor-detected signal and the connection error signal respectively in step S105 and step S106 becomes the steering side control unit 20.

Processing (S109 to S112) executed by the steering side control unit 20 in response to issuance of the request in step S101 becomes the same processing described earlier with reference to FIG. 4. Therefore, description will be omitted.

As described above, a communication device (the telemetry adapter 18 or the receiver unit 10A) includes the first terminal unit (the first terminal unit 18*a* or the first terminal unit 10Aa). The first terminal unit is connected to the actuator devices having sensors (the first aileron servomotor 17-1 and the second aileron servomotor 17-2). Transmission of the steering signal transmitted from the steering wireless device (the steering wireless device 2) to the actuator devices, and transmission of detected signal detected by the sensors in the actuator devices are conducted via the first terminal unit Furthermore, the communication device includes the control unit (the control unit 18*b* or the steered side control unit 12A). The control unit conducts processing to generate the connection error signal representing that the actuator devices are not connected on the basis of a result of determination whether the detected signal is acquired from the actuator devices via the first terminal unit, and transmit the connection error signal to the steering wireless device side.

As a result, confirmation of connection of the actuator devices is conducted on the basis of whether the sensor-detected signal is acquired via the terminal unit for transmitting the steering signal or the sensor-detected signal with the actuator device.

Therefore, a wireless steering system capable of notifying that connection of the actuator devices is forgotten can be implemented without providing terminals for conduction confirmation additionally.

Furthermore, it is possible to implement a wireless steering system capable of notifying that connection of the actuator devices is forgotten without forcing the user to purchase new actuator devices having terminals for conduction confirmation.

Furthermore, the communication device in the embodiment includes the second terminal unit (the second terminal unit 18*c*) connected to the receiver unit (the receiver unit 10) side including the communication unit (the steered side communication unit 11), which conducts wireless communication with the steering wireless device.

The communication device is inserted between the receiver unit and the actuator devices and used as represented by the telemetry adapter 18 illustrated in FIG. 3.

In implementing the wireless steering system capable of giving a notice that connection of the actuator devices is forgotten without providing terminals for conduction confirmation additionally, therefore, the existing receiver unit and actuator devices can be applied. In other words, it is possible to implement the wireless steering system capable of notifying that connection of the actuator devices is forgotten without providing terminals for conduction confirmation additionally, by only adding the communication device (telemetry adapter) in the existing wireless steering system.

In addition, the communication device includes the communication unit (the steered side communication unit 11), which conducts wireless communication with the steering wireless device.

The communication device is equivalent to a receiver unit having a communication unit to conduct wireless communication with the steering wireless device, such as the receiver unit 10A illustrated in FIG. 5.

In implementing the wireless steering system capable of notifying that connection of the actuator devices is forgotten without providing a terminal for conduction confirmation additionally, therefore, it is not necessary to mount an additional device such as the telemetry adapter 18 on the steered device, resulting in reduction in the number of devices in the steered device and weight reduction.

Furthermore, the steered device (the steered device 1 or the steered device 1A) includes actuator devices having sensors (the first aileron servomotor 17-1 and the second aileron servomotor 17-2). The steered device (the steered device 1 or the steered device 1A) in the embodiments further includes the communication device. The communication device includes the first terminal unit (the first terminal unit 18*a* or the first terminal unit 10Aa). The first terminal unit is connected to the actuator devices side. Transmission of the steering signal transmitted from the steering wireless device (the steering wireless device 2) to the actuator devices, and transmission of detected signal detected by the sensors in the actuator devices are conducted via the first terminal unit. The communication device further includes the control unit (the control unit 18*b* or the steered side control unit 12A). The control unit conducts processing to generate the connection error signal representing that the actuator devices are not connected on the basis of a result of determination whether a detected signal is acquired from the actuator devices via the first terminal unit, and transmit the connection error signal to the steering wireless device side.

In such a steered device as well, confirmation of connection of the actuator devices is conducted on the basis of whether the sensor-detected signal is acquired via the terminal unit for transmitting the steering signal and the sensor-detected signal with the actuator devices, in the same way as the communication device described above.

Therefore, the same effects as those of the communication device described above can be obtained.

In addition, in the steered device, a portion (the main plane unit 1*b*) is made capable of being attached to/detached from the main body unit (the main body unit 1*a*). The actuator devices are disposed in the portion, and the communication device is disposed in the main body unit.

As a result, it is possible to notify that connection of the actuator devices disposed in the portion of the steered device to the main body unit side is forgotten.

Heretofore, embodiments according to the present invention have been described. However, the present invention should not be restricted to the above-describe concrete examples, but various modification are conceivable.

For example, the form of the steered device to which the present invention is applied is not restricted to the form of the airplane exemplified above, but it may be a form such as a helicopter, a vehicle, a ship or a robot. A concrete form is not especially restricted.

The actuator devices are not restricted to motor devices such as servomotors. The actuator devices may be devices having other actuators such as solenoids or piezoelectric elements.

In the foregoing description, the case where the communication device according to the present invention is set to be a device corresponding to bus communication (the case where the first terminal unit is set to be a terminal unit to which bus wiring lines can be connected) has been exemplified. However, correspondence to the bus communication is not indispensable. The present invention can also be suitably applied to a case where a communication method other than bus communication is adopted, such as a case where communication is conducted via wiring lines provided independently every channel of the steering signal.

In the foregoing description, the case where a notice of a connection error is given by display has been exemplified. However, the notice using a sound may be given by providing a voice output unit such as a speaker.

What is claimed is:

1. A communication device comprising:

a first terminal unit configured to electrically connect to a servomotor having a sensor, wherein the first terminal unit is configured to receive a steering signal, transmitted from a steering wireless device, being transmitted to the servomotor, and receives a detected signal, detected by the sensor of the servomotor, indicating that the servomotor is not electrically connected; and a control unit configured to generate a connection error signal when the servomotor is not electrically connected based on a result of determination whether the detected signal is transmitted from the servomotor via the first terminal unit or not, and configured to transmit the connection error signal to the steering wireless device, wherein a portion of a steered device is configured to be detachable from a main body unit of the steered device, and the servomotor is disposed in the portion, and the communication device is disposed in the main body unit.

2. The communication device according to claim 1, further comprising a second terminal unit configured to connect to a receiver unit including a communication unit configured to conduct wireless communication with the steering wireless device.

3. The communication device according to claim 1, further comprising a communication unit configured to conduct wireless communication with the steering wireless device.

4. A steered device comprising:

a servomotor having sensor; and a communication device including a first terminal unit configured to electrically connect to the servomotor, wherein the first terminal unit is configured to receive a steering signal, transmitted from a steering wireless device, being transmitted to the servomotor, and receives a detected signal, detected by the sensor of the servomotor, indicating that the servomotor is not electrically connected, and a control unit configured to generate a connection error signal when the servomotor is not electrically connected based on a result of determination whether the detected signal is transmitted from the servomotor via the first terminal unit or not, and configured to transmit the connection error signal to the steering wireless device, wherein a portion of the steered device is configured to be detachable from a main body unit of the steered device, and the servomotor is disposed in the portion, and the communication device is disposed in the main body unit.

* * * * *